US012460415B2

(12) United States Patent
Vowles

(10) Patent No.: US 12,460,415 B2
(45) **Date of Patent: *Nov. 4, 2025**

(54) ROOF FLASHING

(71) Applicant: Dennis Vowles, Toledo, OH (US)

(72) Inventor: Dennis Vowles, Toledo, OH (US)

( * ) Notice: Subject to any disclaimer, the term of this patent is extended or adjusted under 35 U.S.C. 154(b) by 226 days.

This patent is subject to a terminal disclaimer.

(21) Appl. No.: 18/277,097

(22) PCT Filed: Feb. 11, 2022

(86) PCT No.: PCT/US2022/016059

§ 371 (c)(1),
(2) Date: Aug. 14, 2023

(87) PCT Pub. No.: WO2022/174008

PCT Pub. Date: Aug. 18, 2022

(65) Prior Publication Data

US 2024/0125125 A1 Apr. 18, 2024

Related U.S. Application Data

(60) Provisional application No. 63/148,670, filed on Feb. 12, 2021.

(51) Int. Cl.
*E04D 13/147* (2006.01)

(52) U.S. Cl.
CPC ..... *E04D 13/1476* (2013.01)

(58) Field of Classification Search
CPC ..... E04D 13/1476; E04D 2001/307; E04D 13/147; F24F 7/02
See application file for complete search history.

(56) References Cited

U.S. PATENT DOCUMENTS

| | | | | |
|---|---|---|---|---|
| 791,068 | A * | 5/1905 | Baker | E04D 13/1476 285/43 |
| 917,167 | A * | 4/1909 | Shaw | E04D 13/1476 126/318 |
| 1,258,884 | A * | 3/1918 | Fife | E04D 13/1476 285/43 |
| 2,800,850 | A * | 7/1957 | McKann | F23L 17/02 454/366 |
| 3,313,559 | A * | 4/1967 | Kifer | E04D 13/1476 285/43 |
| 3,677,576 | A * | 7/1972 | Gustafson | E04D 13/1471 285/43 |

(Continued)

*Primary Examiner* — Rodney Mintz
(74) *Attorney, Agent, or Firm* — David C Purdue

(57) ABSTRACT

A roof flashing is disclosed herein. The roof flashing can include a bottom half having a first plate and a first neck portion and also a top half having a second plate and a second neck portion. At least one of the first neck portion and the second neck portion can include a pipe portion formed from a first material and a sealing portion formed from a second material. The sealing portion can define one of the first portion of the aperture and the second portion of the aperture. The first material can be more rigid than the second material. The sealing portion can define a top surface facing upwardly and a bottom surface facing downwardly and a plurality of beads projecting outwardly from the top surface and a plurality of channels extending inwardly into the bottom surface.

11 Claims, 14 Drawing Sheets

(56) References Cited

U.S. PATENT DOCUMENTS 3,731,952 A * 5/1973 Elwart ..... E04D 13/1476 285/44
3,807,110 A * 4/1974 Kaminski ..... E04D 13/1407 285/4
3,945,163 A * 3/1976 Nagler ..... E04D 13/1407 52/98
4,010,578 A * 3/1977 Logsdon ..... E04D 13/1471 285/44
4,120,129 A * 10/1978 Nagler ..... E04D 13/1407 285/44
4,211,423 A * 7/1980 Resech ..... E04D 13/1407 277/944
4,265,058 A * 5/1981 Logsdon ..... E04D 13/1476 285/43
4,333,660 A * 6/1982 Cupit ..... E04D 13/1476 52/60
4,563,847 A * 1/1986 Hasty ..... E04D 13/1476 52/98
4,570,396 A * 2/1986 Struben ..... E04D 13/064 52/90.2
4,635,409 A * 1/1987 Vandemore ..... E04D 13/1407 52/60
4,664,390 A * 5/1987 Houseman ..... F16J 3/042 277/606
4,864,782 A * 9/1989 Hasty ..... E04D 13/1471 52/60
4,903,997 A * 2/1990 Kifer ..... E04D 13/1476 285/43
4,937,991 A * 7/1990 Orth ..... E04D 13/1407 52/60
5,036,636 A * 8/1991 Hasty ..... E04D 13/1476 52/60
5,176,408 A 1/1993 Pedersen
5,226,263 A * 7/1993 Merrin ..... E04D 13/1476 285/43
5,472,241 A * 12/1995 Kosik, Jr. ..... E04D 13/1476 285/43
5,588,267 A * 12/1996 Rodriguez ..... E04D 13/1476 285/4
5,860,256 A * 1/1999 Humber ..... E04D 13/1476 52/219
5,899,034 A * 5/1999 Vermilion ..... E04D 13/1407 285/285.1
5,946,863 A * 9/1999 Bullard ..... E04D 13/1476 52/60
5,970,667 A * 10/1999 Thaler ..... E04D 13/1407 52/60
6,327,820 B1 * 12/2001 Picco ..... E04D 13/1475 52/60
6,601,351 B1 * 8/2003 Zerfoss ..... E04D 13/1471 285/43
6,601,352 B1 * 8/2003 Obermeyer ..... E04B 9/003 52/202
6,691,469 B2 * 2/2004 Miller ..... E04D 13/1476 52/220.8
8,141,303 B2 * 3/2012 McDow, Jr. ..... E04D 13/1476 52/63
8,291,658 B1 * 10/2012 Johnston ..... H02G 3/22 52/220.8
8,397,438 B2 * 3/2013 Hoy ..... E04D 13/1476 52/302.1
8,464,475 B2 * 6/2013 McDow, Jr. ..... E04D 13/1476 52/63
8,534,002 B2 * 9/2013 McDow, Jr. ..... E04D 13/1476 52/63
8,608,206 B2 * 12/2013 Fedale, Sr. ..... E04D 13/1407 285/43
9,169,648 B1 * 10/2015 Mills ..... E04D 13/1476
9,909,320 B2 * 3/2018 Vowles ..... E04D 13/1476
10,132,084 B2 * 11/2018 Gilleran ..... E04D 13/1476
D878,543 S * 3/2020 Green ..... D23/393
D936,250 S * 11/2021 Oddy ..... D25/199
D979,102 S * 2/2023 DeGraan ..... D25/199
2002/0108316 A1 * 8/2002 Miller ..... E04D 13/1476 52/302.1
2007/0101664 A1 5/2007 Hoy et al.
2011/0094165 A1 * 4/2011 McDow, Jr. ..... E04D 13/1476 52/219
2012/0126530 A1 5/2012 Fedal, Sr. et al.
2012/0186181 A1 * 7/2012 McDow, Jr. ..... E04D 13/1476 52/518
2013/0113204 A1 * 5/2013 McDow, Jr. ..... E04D 13/1476 285/42
2017/0159296 A1 6/2017 Vowles
2017/0204601 A1 7/2017 Gilleran

* cited by examiner

ROOF FLASHING

CROSS-REFERENCE TO RELATED APPLICATIONS

This application is a National Phase application of International App. No. PCT/US2022/016059, filed 11 Feb. 2022, titled ROOF FLASHING, which claimed the benefit of U.S. Provisional Patent Application Ser. No. 63/148,670 for a ROOF FLASHING, filed on Feb. 12, 2021, and both applications are hereby incorporated by reference in their entireties.

BACKGROUND

1. Field

The present disclosure relates to roof flashing.

2. Description of Related Prior Art

U.S. Pat. No. 6,691,469 discloses FLASHING FOR ROOF PENETRATIONS. A flashing for sealing about a roof penetration includes a first sheet having a first edge. The first sheet includes a substantially planar portion and a portion that is inclined with respect to the planar portion. The inclined portion has a recess open at the first edge. A second sheet has a first edge. The second sheet includes a substantially planar portion and a portion that is inclined with respect to the planar portion. The inclined portion has a recess open at the first edge.

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

SUMMARY

A roof flashing is disclosed herein. The roof flashing can include a bottom half having a first plate extending in a first plane and a first neck portion projecting away from the first plate and the first plane. The first neck portion can be arcuate and centered on a first axis that intersects the first plane at an acute angle. The first neck portion can define a first portion of an aperture configured to encircle and seal against a post projecting away from a roof. The roof flashing can also include a top half having a second plate and a second neck portion projecting away from the second plate. The second neck portion can be arcuate and centered on a second axis that intersects the second plate at an acute angle. The second neck portion can define a second portion of the aperture. At least part of the first neck portion can be slidably receivable in the second neck portion. The first neck portion and the second neck portion can define a neck of the roof flashing when the bottom half and the top half are engaged with one another. The first plate can extend a length between an upper edge and lower edge. The upper edge can be positioned closer to the first portion of the aperture than the lower edge. At least part of a perimeter of the first neck portion about the first axis can be received in and overlapped by the second neck portion. The at least part of the perimeter can be defined beyond the upper edge and not along the length. The second plate can extend a length between an upper edge and lower edge. The lower edge of the second plate can be positioned closer to the second portion of the aperture than the upper edge. The second neck portion need not extend past a lower edge of the second plate and can extend along the length of the second plate. At least one of the first neck portion and the second neck portion can include a pipe portion formed from a first material and a sealing portion formed from a second material. The sealing portion can define one of the first portion of the aperture and the second portion of the aperture. The first material can be more rigid than the second material. The sealing portion can define a top surface facing upwardly and a bottom surface facing downwardly and a plurality of beads projecting outwardly from the top surface and a plurality of channels extending inwardly into the bottom surface.

BRIEF DESCRIPTION OF THE DRAWINGS

The detailed description set forth below references the following drawings.

DETAILED DESCRIPTION

Figure 1:
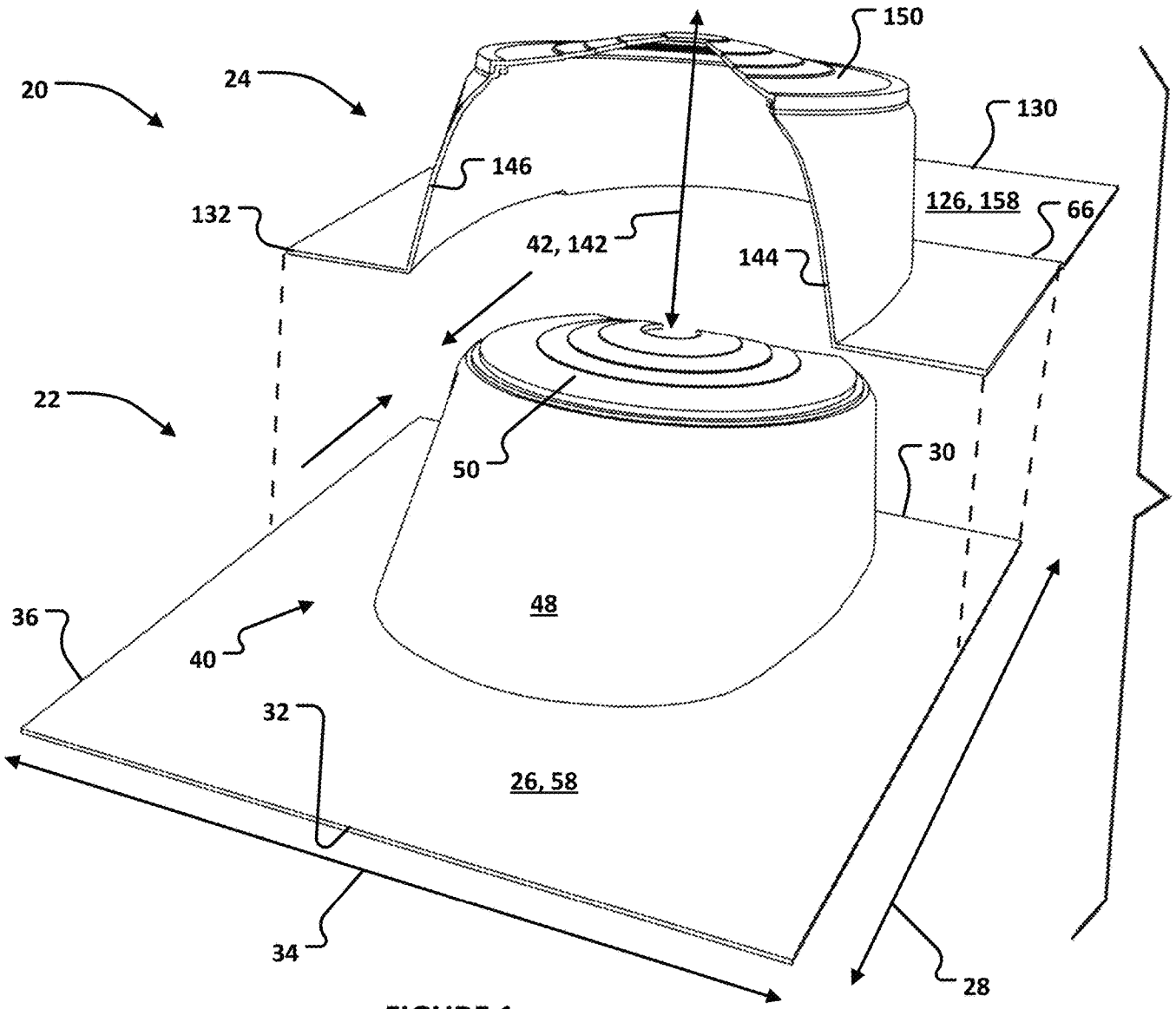
FIG. 1 is an exploded view of an exemplary embodiment of the present disclosure.
Figure 3:
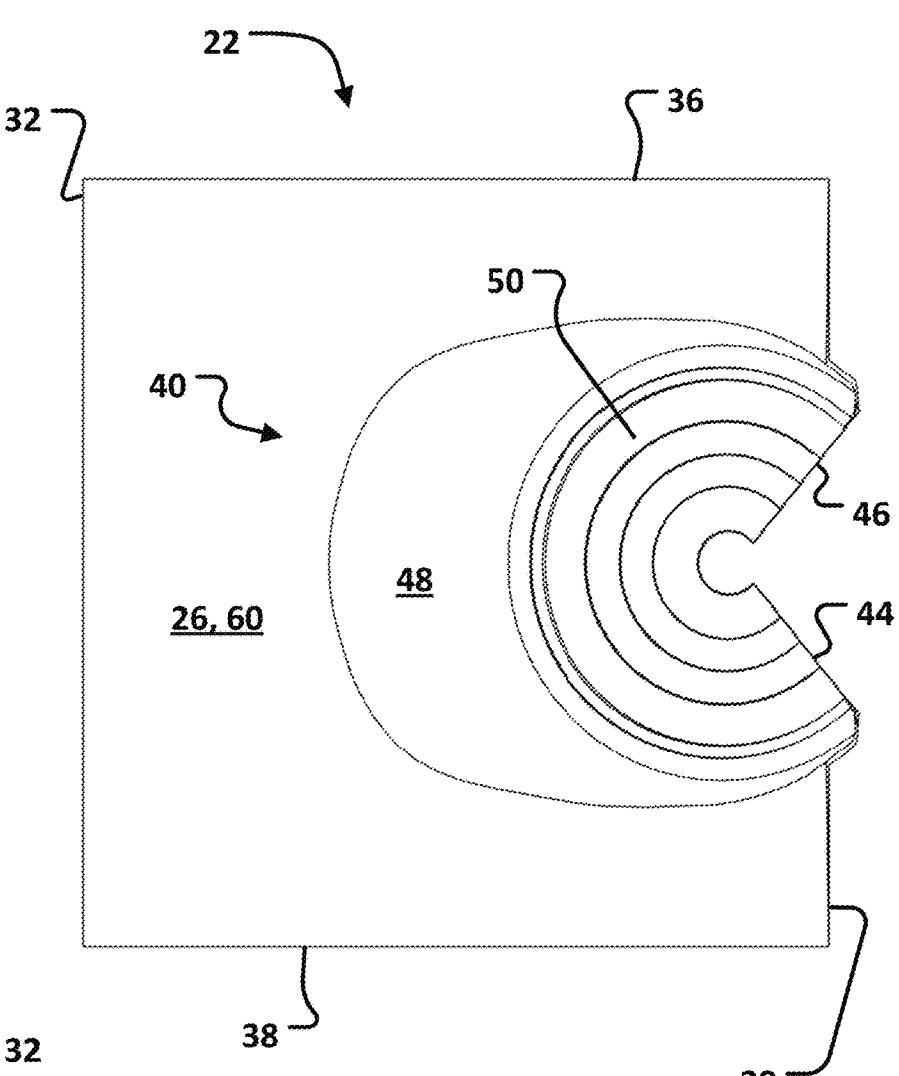
FIG. 3 is a bottom view of the bottom half of the exemplary embodiment of the present disclosure.
Figure 2:
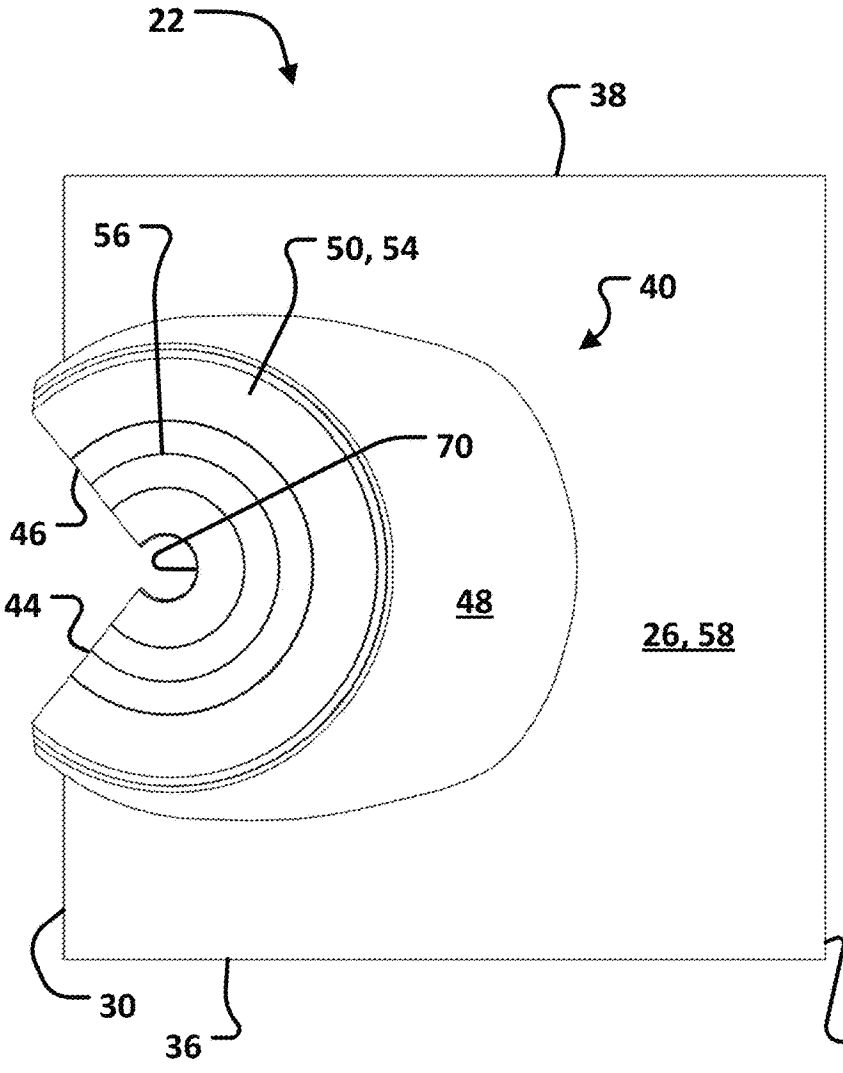
FIG. 2 is a top view of a bottom half of the exemplary embodiment of the present disclosure.
Figure 4:
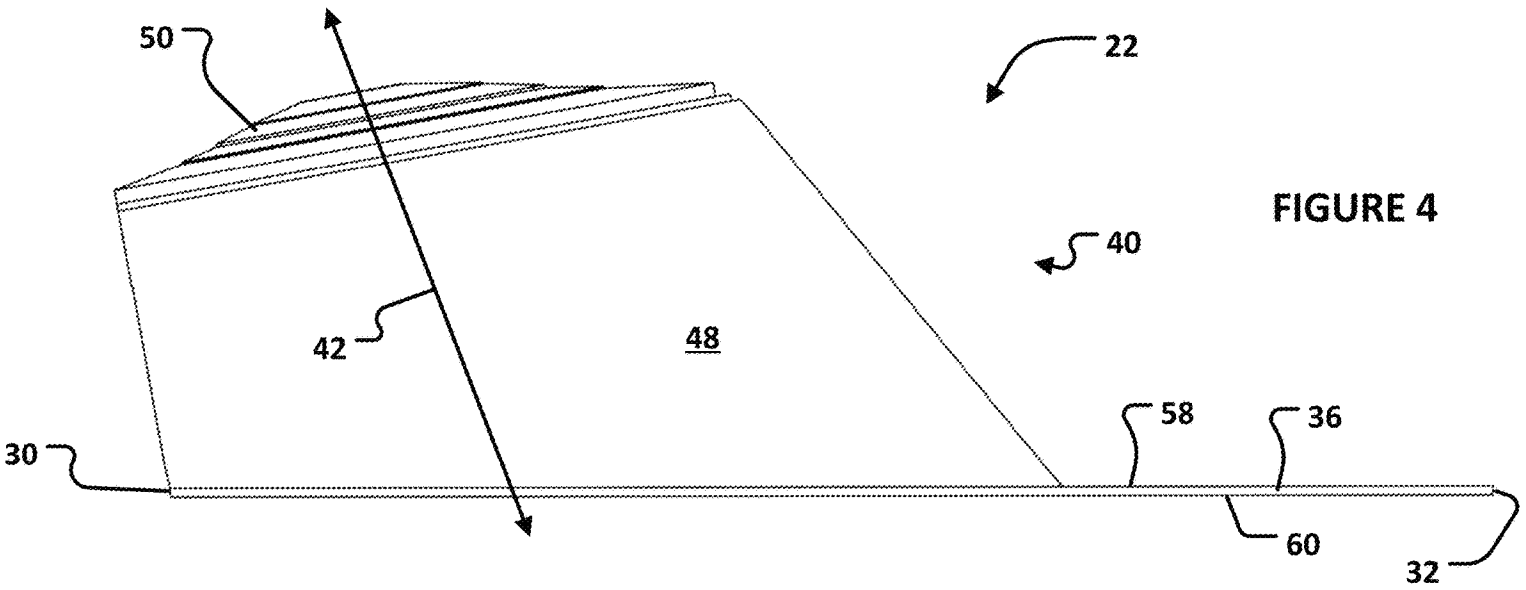
FIG. 4 is a front view of the bottom half of the exemplary embodiment of the present disclosure.
Figure 5:
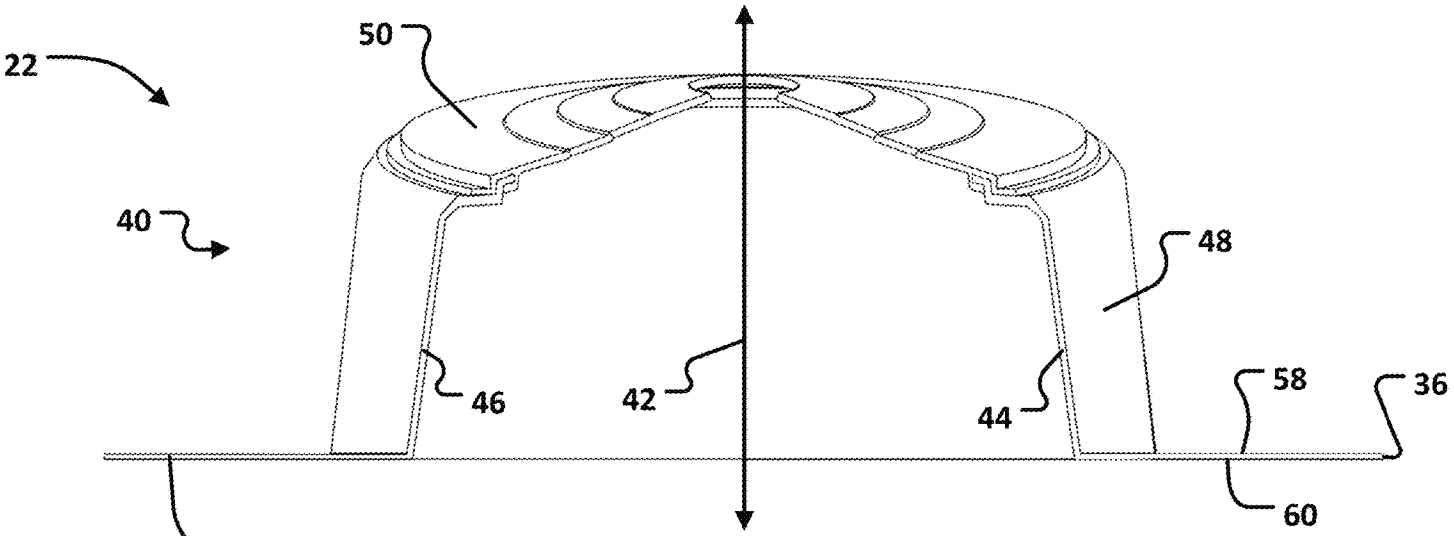
FIG. 5 is a left-side view of the bottom half of the exemplary embodiment of the present disclosure.
Figure 7:
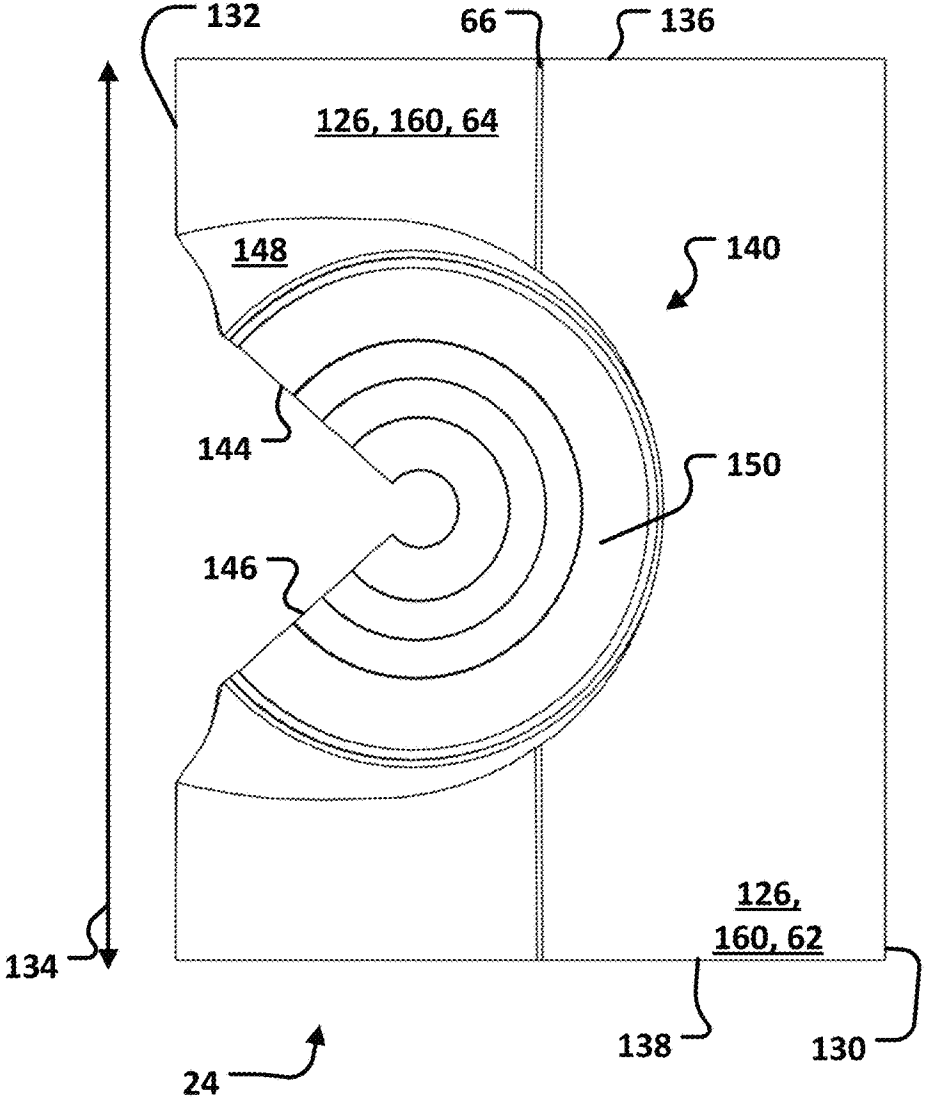
FIG. 7 is a bottom view of the top half of the exemplary embodiment of the present disclosure.
Figure 6:
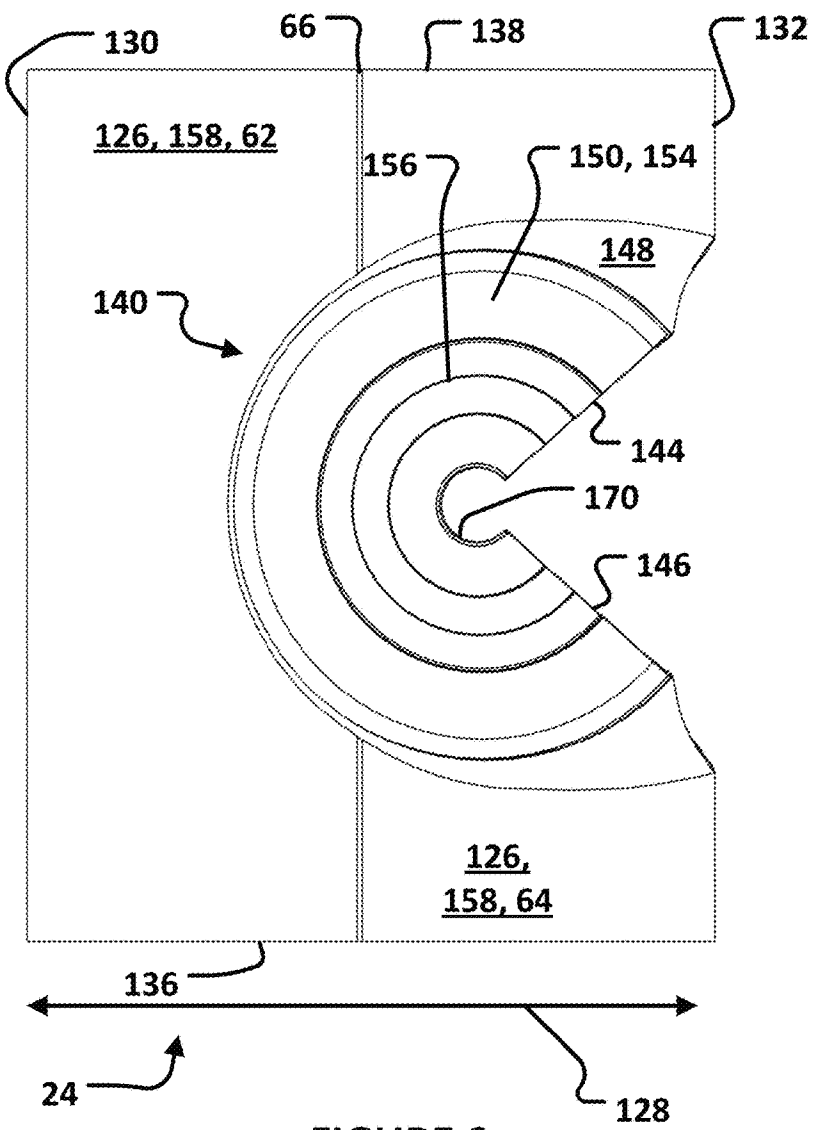
FIG. 6 is a top view of a top half of the exemplary embodiment of the present disclosure.
Figure 8:
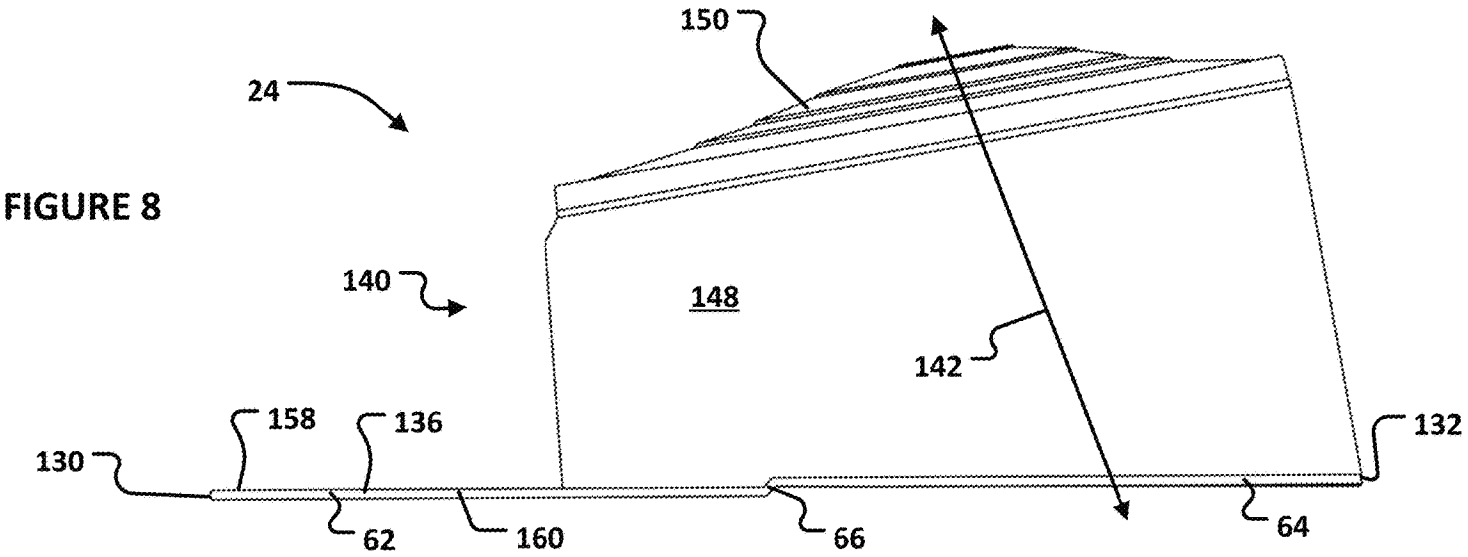
FIG. 8 is a front view of the top half of the exemplary embodiment of the present disclosure.
Figure 9:
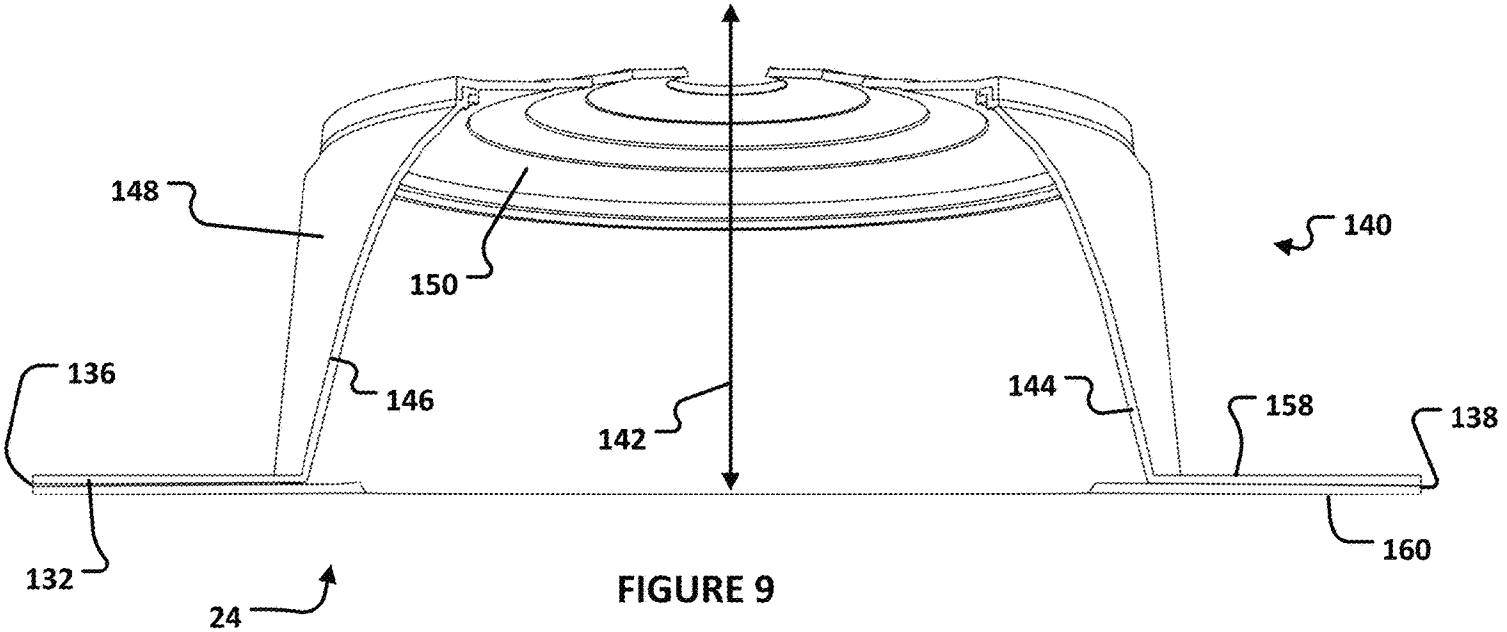
FIG. 9 is a right-side view of the top half of the exemplary embodiment of the present disclosure.
Figure 10:
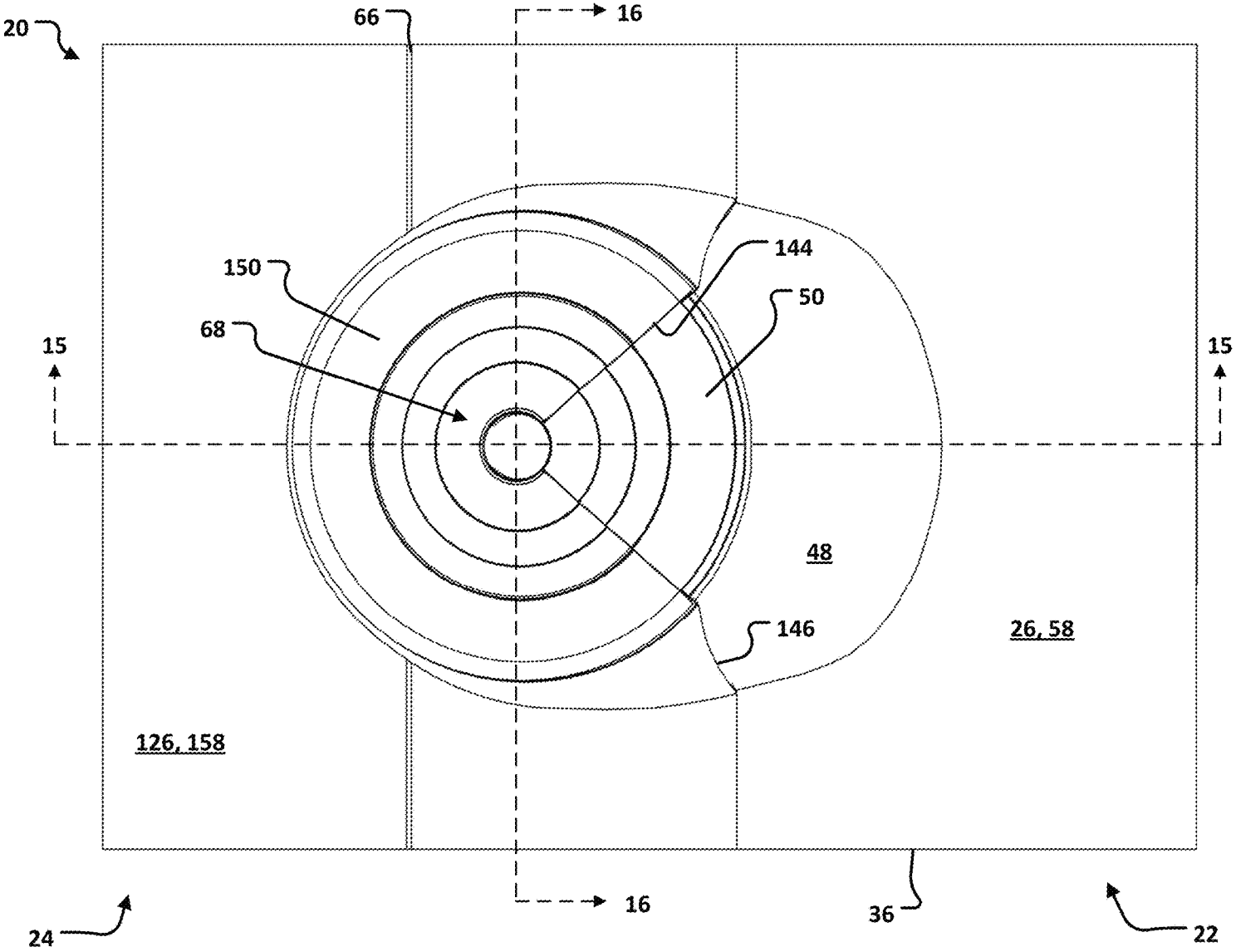
FIG. 10 is a top view of the exemplary embodiment of the present disclosure.

An assembled and exemplary roof flashing according to the present disclosure is referenced at 20 in the drawing figures. The exemplary roof flashing 20 includes a bottom half 22 and a top half 24. The bottom half 22 is shown without the top half 24 in FIGS. 2-5. The top half 24 is shown without the bottom half 22 in FIGS. 6-9.

The exemplary bottom half 22 has a first plate 26 extending general in a first plane. The exemplary bottom half 22 has a thickness so it does not extend only in single plane, but is generally planar. The first plane can lie flush with the surface of a roof on which the roof flashing 20 is mounted. The first plate 26 can extend a length (referenced at 28) between an upper edge 30 and lower edge 32. The first plate 26 can also extend a width (referenced at 34) between a first lateral edge 36 and a second lateral edge 38. The first plate 26 can also have a thickness defined between a top surface 58 and a bottom surface 60.

The exemplary bottom half 22 also has a first neck portion 40 projecting away from the first plate 26 and the first plane. The exemplary first neck portion 40 has a shape that is frusto- as well as bi-conical. The exemplary first neck portion 40 is generally half of a cone without a pointed top. The exemplary first neck portion 40 is arcuate about and centered on a first axis 42 that intersects the first plane at an acute angle. The exemplary first neck portion 40 can extend about the first axis 42 between a first edge 44 and a second edge 46.

Figure 18:
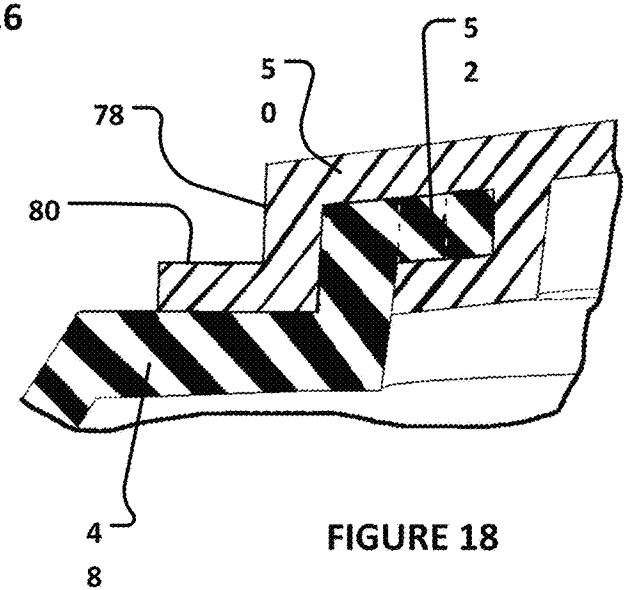
FIG. 18 is a detail view of the bottom half of the exemplary embodiment of the present disclosure.

The exemplary first neck portion 40 further comprises a pipe portion 48 formed from a first material. The exemplary first neck portion 40 further comprises a sealing portion 50 formed from a second material. Both of the exemplary pipe portion 48 and the sealing portion 50 extend between first and second edges 44, 46. The first material is more rigid than the second material. The first material can be a relatively rigid plastic such as polypropylene and the second material can be a relatively flexible material such a rubber or urethane. The sealing portion 50 cane formed in situ on the pipe portion 48. The exemplary pipe portion 48 includes a plurality of apertures and the exemplary sealing portion 50 is formed in situ on the pipe portion 48. During application of the sealing form (in liquid form), the second material can flow through the apertures so that the cured sealing portion 50 extends through the plurality of apertures. An exemplary aperture is referenced in hidden line in FIG. 18 at 52. The exemplary sealing portion 50 is also formed to define a plurality of arcuate, c-shaped portions, such as referenced at 54, interconnected by webs, such as referenced at 56. A user can removed any of the c-shaped portions to accommodate differently-sized posts by cutting the sealing portion 50 along the appropriate web.

The exemplary top half 24 has a second plate 126. The second plate 126 can extend a length (referenced at 128) between an upper edge 130 and lower edge 132. The second plate 126 can also extend a width (referenced at 134) between a first lateral edge 136 and a second lateral edge 138. The second plate 126 can also have a thickness defined between a top surface 158 and a bottom surface 160. The first and second plates 26, 126 can be nailed into a roof when installed.

The exemplary second plate 126 is configured differently than the exemplary first plate 26. The exemplary second plate 126 includes a first plate portion 62 extending in a second plane. In the exemplary embodiment, the first and second planes are coplanar when the bottom half 22 and the top half 24 are engaged with one another. In other embodiments, the first plate portion 62 and the first plate 26 may not be in the same plane. The exemplary second plate 126 also includes a second plate portion 64 extending in a third plane. The second plane and the third plane are parallel to one another.

The exemplary second plate 126 also includes a riser portion 66 extending between the first plate portion 62 and the second plate portion 64. The first plate 26 abuts the riser portion 66 and is partially overlapped by the second plate portion 64 when the bottom half 22 and the top half 24 are engaged with one another. The exemplary riser portion 66 extends non-perpendicularly relative to the second plane and the third plane.

Figure 15:
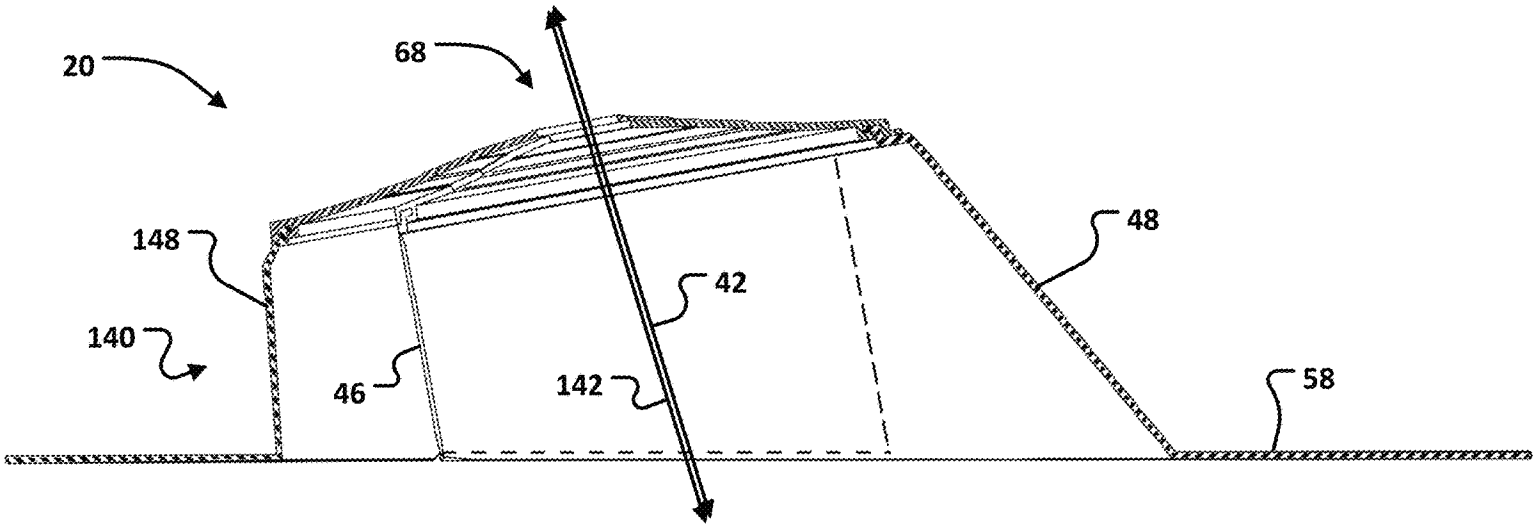
FIG. 15 is a cross-section of the exemplary embodiment of the present disclosure taken through section lines 15-15 in FIG. 10.

The exemplary top half 24 also has a second neck portion 140 projecting away from the second plate 126 and the first plane. The exemplary second neck portion 140 has a shape that is frusto- as well as bi-conical. The exemplary second neck portion 140 is generally half of a cone without a pointed top. The exemplary second neck portion 140 is arcuate about and centered on a second axis 142 that intersects the first plane at an acute angle. The exemplary second neck portion 140 can extend about the second axis 142 between a first edge 144 and a second edge 146. FIGS. 1, 12, 13, and 16 show the axes 42, 142 aligned. FIG. 15 shows the axes offset from one another. Embodiments of the present disclosure can be practiced with the axes 42, 142 aligned and with the axes 42, 142 offset from one another.

Figure 17:
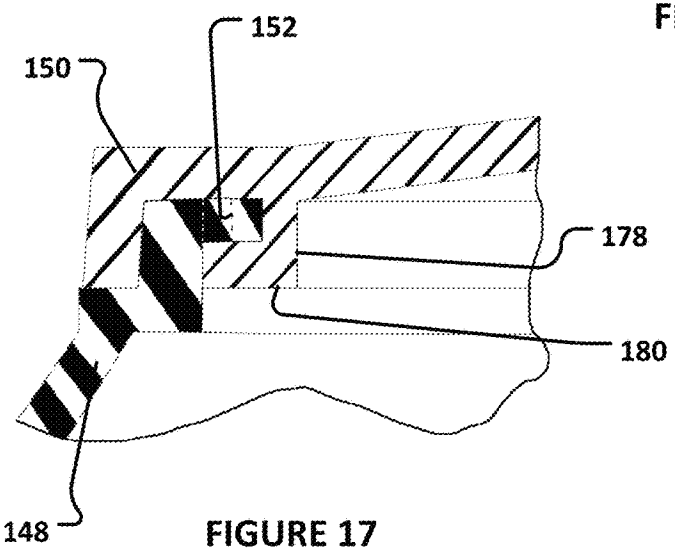
FIG. 17 is a detail view of the top half of the exemplary embodiment of the present disclosure.

The exemplary second neck portion 140 further comprises a pipe portion 148 formed from a first material. The exemplary second neck portion 140 further comprises a sealing portion 150 formed from a second material. Both of the exemplary pipe portion 148 and the sealing portion 150 extend between first and second edges 144, 146. The first material is more rigid than the second material. The first material can be a relatively rigid plastic such as polypropylene and the second material can be a relatively flexible material such a rubber or urethane. The sealing portion 150 cane formed in situ on the pipe portion 148. The exemplary pipe portion 148 includes a plurality of apertures and the exemplary sealing portion 150 is formed in situ on the pipe portion 148. During application of the sealing form (in liquid form), the second material can flow through the apertures so that the cured sealing portion 150 extends through the plurality of apertures. An exemplary aperture is referenced in hidden line in FIG. 17 at 152. The exemplary sealing portion 150 is also formed to define a plurality of arcuate, c-shaped portions, such as referenced at 154, interconnected by webs, such as referenced at 156. A user can removed any of the c-shaped portions to accommodate differently-sized posts by cutting the sealing portion 150 along the appropriate web.

Referring now to FIG. 1, the roof flashing 20 can be assembled to a post protruding from a roof by first placing the bottom half 22 on the roof and sliding the bottom half 22 against the post until an aperture defined by the sealing portion 50 abuts the post. The aperture will be detailed below. Next, the top half 24 can be placed on the roof and slid across the roof until an aperture defined by the sealing portion 150 abuts the post. The halves 22, 24 can be moved toward one another until the upper edge 30 abuts the riser portion 66.

Figure 16:
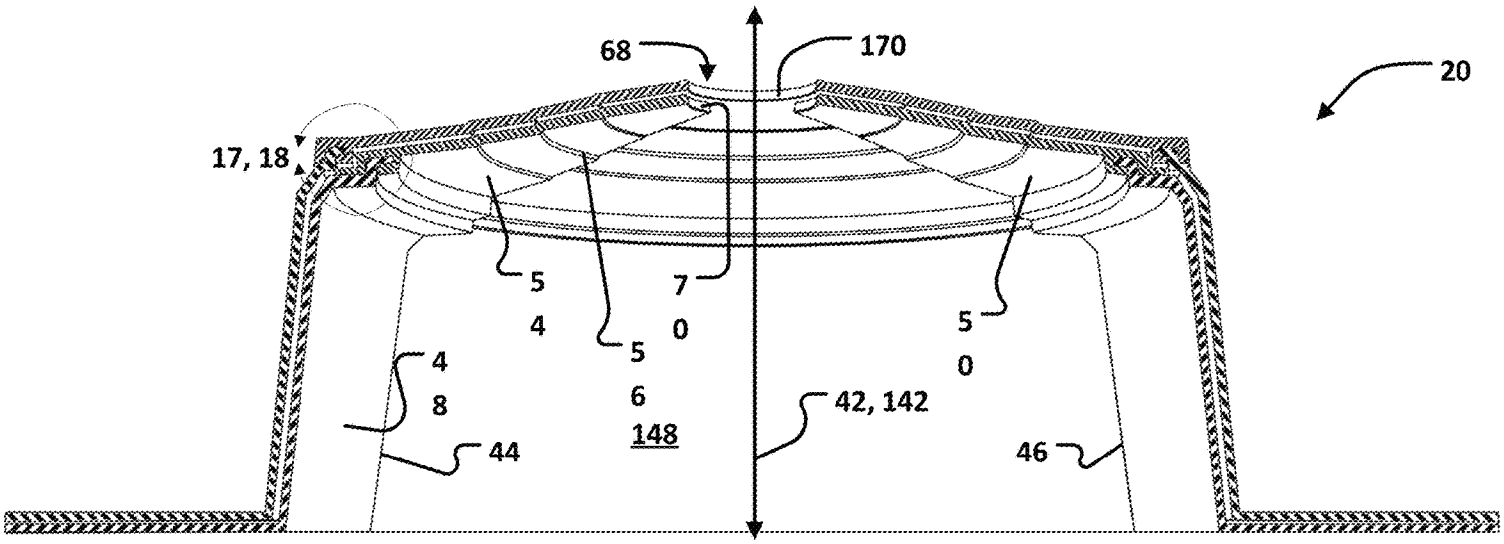
FIG. 16 is a cross-section of the exemplary embodiment of the present disclosure taken through section lines 16-16 in FIG. 10.

The bottom half 22 and the top half 24 cooperate to form the aperture surrounding the post when the bottom half 22 and the top half 24 are engaged with one another. The aperture is referenced at 68. The exemplary aperture 68 can be discontinuous as shown in FIGS. 15 and 16. The first neck portion 40 can define a first portion 70 of an aperture 68. The upper edge 30 can be positioned closer to the first portion 70 of the aperture 68 than the lower edge 32. The second neck portion 140 can defining a second portion 72 of the aperture 68. The lower edge 132 can be positioned closer to the second portion 170 of the aperture 68 than the upper edge 130. The first portion 70 is defined by the sealing portion 50 and the second portion 170 is defined by the sealing portion 150. The exemplary first portion 70 is below the exemplary second portion 170. The exemplary first portion 70 overlaps the exemplary second portion 170 along portions of the circumference of the aperture 68 about the axes 42, 142. The aperture portions 70, 170 are centered on the axes 42, 142 and the neck portions 40, 140 are also centered on the axes 42, 142. In alternative embodiments of the present disclosure, the aperture portion 70 and neck portion 40 can be centered on different axes and the aperture portion 170 and neck portion 140 can be centered on different axes.

During assembly of the halves 22, 24, at least part of the first neck portion 40 is slidably received in the second neck portion 140. When the bottom half 22 and the top half 24 are engaged with one another, at least part of a circumferential perimeter of the first neck portion 40 about the first axis 42 is received in and overlapped by the second neck portion 140. The first neck portion 40 and the second neck portion 140 define a neck of the roof flashing 20 when the bottom half 22 and the top half 24 are engaged with one another. Adhesive or sealant can be applied between the halves 22, 24 if desired.

Figure 11:
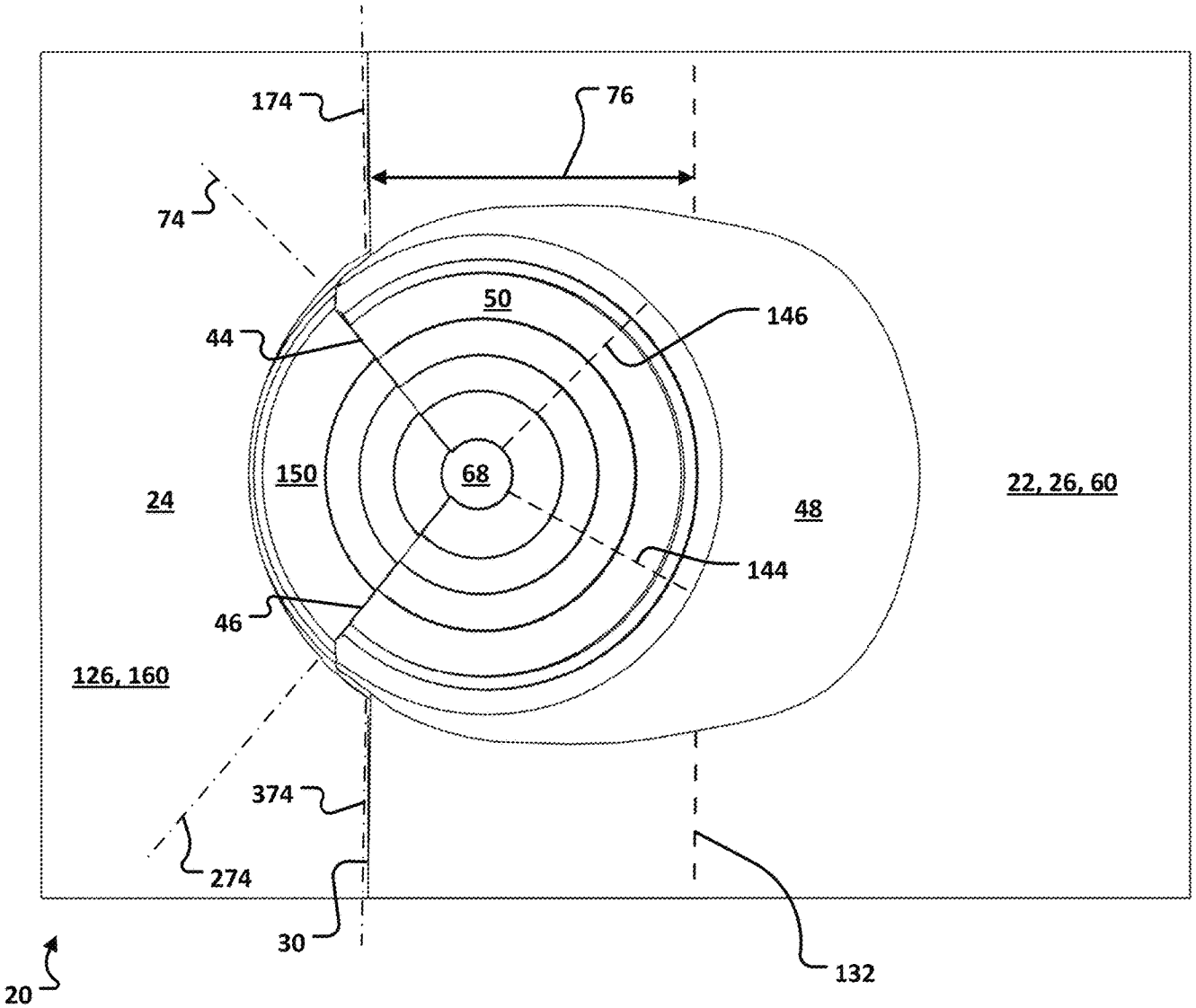
FIG. 11 is a bottom view of the exemplary embodiment of the present disclosure.
Figures 12, 13:
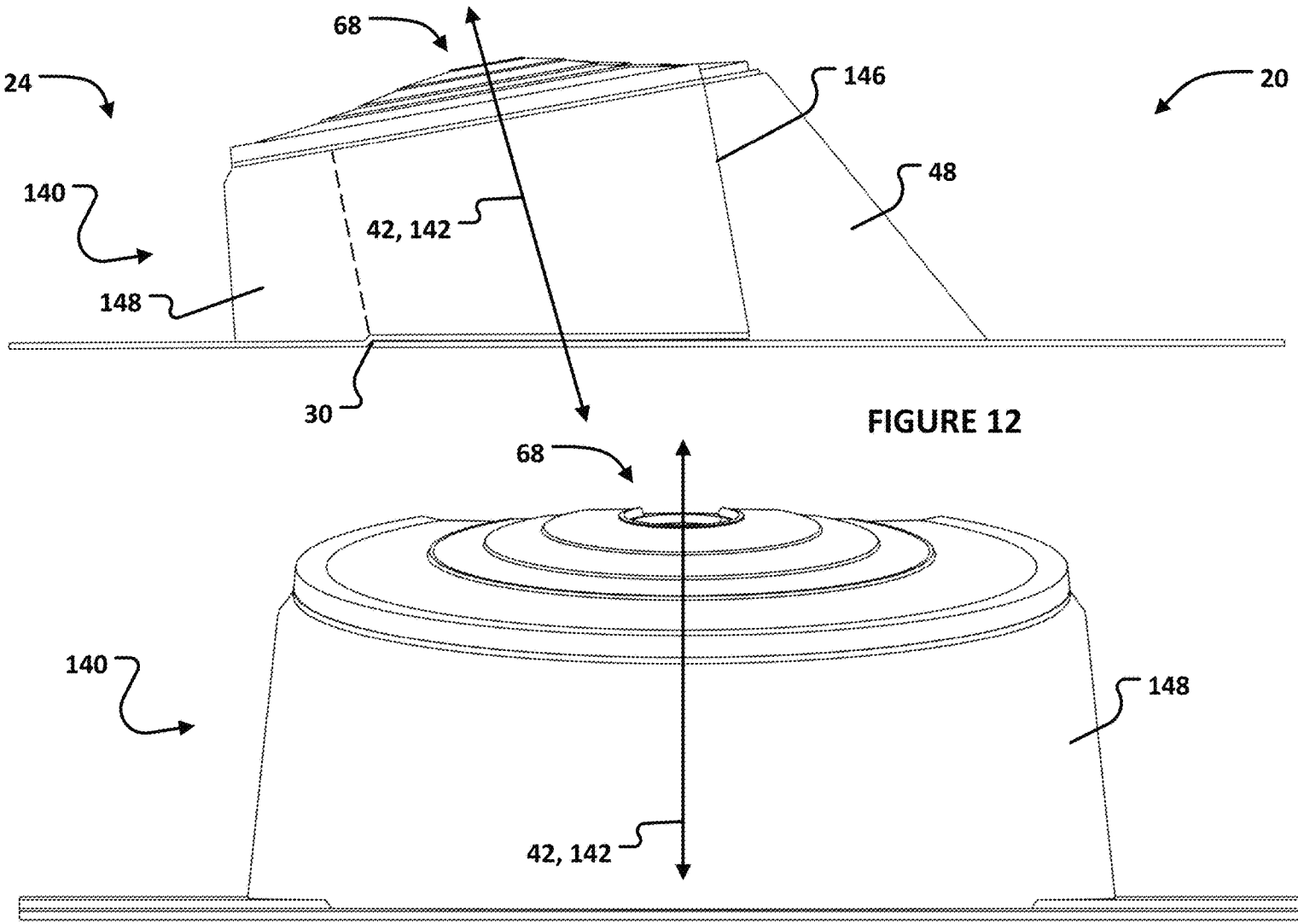
FIG. 12 is a front view of the exemplary embodiment of the present disclosure.
FIG. 13 is a right-side view of the exemplary embodiment of the present disclosure.
Figure 14:
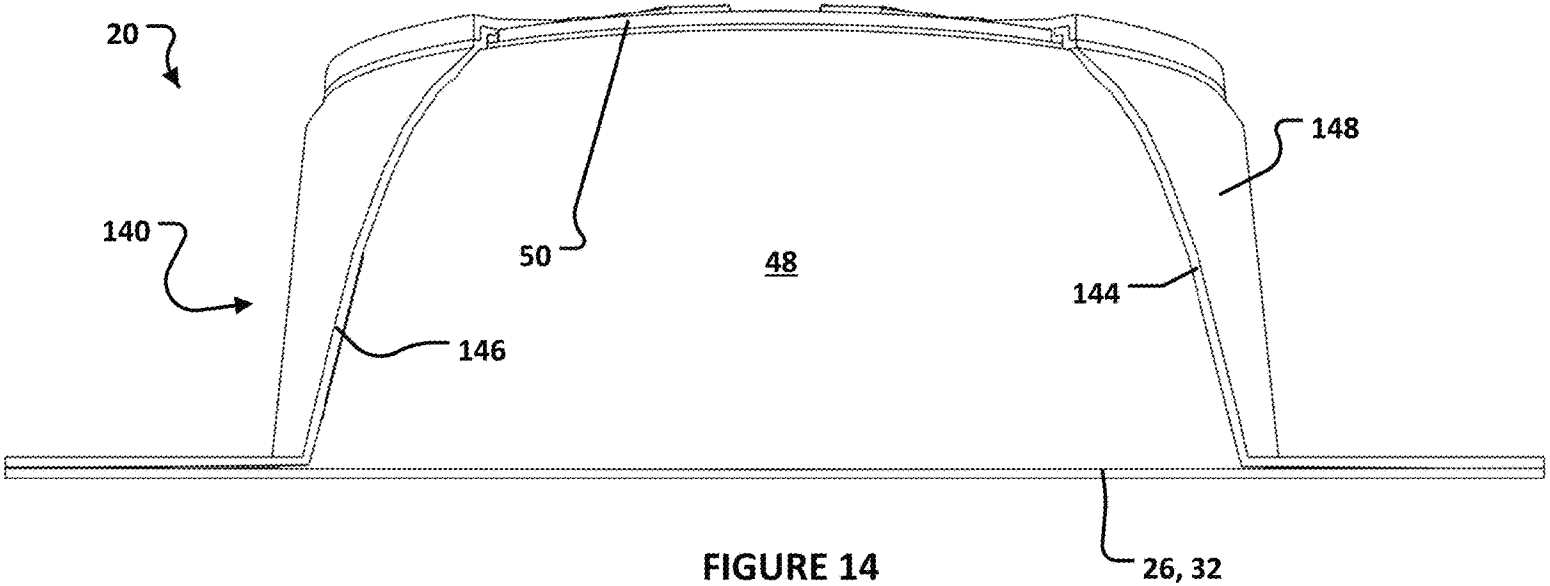
FIG. 14 is a left-side view of the exemplary embodiment of the present disclosure.

In the exemplary embodiment, part of the perimeter of the first neck portion 40 is defined beyond the upper edge 30 and is not positioned along the length 28. This is best shown in FIG. 11 wherein the portion of the first neck portion 40 that is to the left of the upper edge 30 and extends about the aperture 68 between the reference lines 74 and 174 is overlapped by the second neck portion 140 when the bottom half 22 and the top half 24 are engaged with one another and is not defined along the length. Similarly, the portion of the first neck portion 40 that is to the left of the upper edge 30 and extends about the aperture 68 between the reference lines 274 and 374 is overlapped by the second neck portion 140 when the bottom half 22 and the top half 24 are engaged with one another and is not defined along the length. These portions of the perimeter of the first neck portion 40 are a pair of mirrored, parts along its perimeter. In the exemplary embodiment, while the first neck portion 40 extends past the first plate 26, the exemplary second neck portion 140 does not extend past lower edge 32 of the second plate 126. The exemplary second neck portion thus extends only along the length 128 of the second plate 126.

In the exemplary embodiment, a majority of a perimeter of the first neck portion 40 about the first axis 42 is received in and overlapped by the second neck portion 140. With reference to FIG. 11, the first and second neck portions 40, 140 overlap between the edges 44 and 146. Based on the perspective of FIG. 11, this range corresponds to "10" to "2" on a clock. The angle of overlap is approximately eighty-seven degrees. It is noted that all numerical values set forth herein are exemplary and not required for all embodiments of the present disclosure. The first and second neck portions 40, 140 also overlap between the edges 46 and 144. Based on the perspective of FIG. 11, this range corresponds to "4" to "7" on a clock. The angle of overlap is approximately one hundred and one degrees. The first and second neck portions 40, 140 do not overlap between the edges 44 and 46 and between edges 144 and 146. Based on the perspective of FIG. 11, these ranges correspond to "7" to "10" and "2" to "4" on a clock. The angles of overlap are approximately ninety-eight and seventy-four degrees, respectively.

In the exemplary embodiment, each of the first neck portion 40 and the second neck portion 140 extend greater than one hundred and eighty degrees about the respective first and second axes 42, 142. The exemplary first neck portion 40 extends two hundred and sixty-two degrees about the axis 42. The exemplary second neck portion 140 extends two hundred and eighty-six degrees about the axis 142.

In the exemplary embodiment, the first plate 26 and second plate 126 overlap one another along portions of the lengths 28, 128. The first neck portion 40 and the second neck portion 140 also overlap one another about the respective first and second axes 42, 142. The overlap of the neck portions 40, 140 occurs partially over the section of overlap of the lengths 28, 128. Thus the top half 24 and the bottom half 22 overlap one another vertically as well as laterally section of overlap of the lengths 28, 128. This section is referenced at 76.

In the exemplary embodiment, the sealing portion 50 of the first neck portion 40 and the sealing portion 150 of the second neck portion 140 confront one another vertically and horizontally when the bottom half 22 and the top half 24 are engaged with one another. This is shown best in FIGS. 17 and 18. The sealing portion 50 defines an outwardly-facing, partially cylindrical surface 78 that confronts an inwardly-facing, partially cylindrical surface 178 defined by the sealing portion 150. When the bottom half 22 and the top half 24 are engaged with one another, the surfaces 78, 178 are pressed into contact with one another and define a seal. The sealing portion 50 also defines an upwardly-facing, ring-shaped surface 80 that confronts a downwardly-facing, ring-shaped surface 180 defined by the sealing portion 150. When the bottom half 22 and the top half 24 are engaged with one another, the surfaces 80, 180 are pressed into contact with one another and define a seal. It is again noted that sealant can be directed into any gaps between the halves 22, 24.

The present disclosure, as demonstrated by the exemplary embodiment described above, can provide an improved roof flashing over the state of the art. A wider range of post sizes can be accommodated, such as posts between one and one-half inches to six inches. Embodiments of the present disclosure can seal around satellite dish antenna arms so the bracket support the dish does not need to be removed when re-shingling the roof. Seals around other pipes (such as up to six inches around) that cannot be sealed with a one-piece flashing. The over-molded sealing portion allows for some sway/motion independent of rigid plates mounted to the roof. Expansion and contraction variations between substrates does not impact on the utility of embodiments of the present disclosure. The relatively rigid pipe portions are not as susceptible to impact, snow, animals or other weight. The rigid plate and pipe portion transitions to a more flexible seal to allow some independent expansion, contraction, seismic, and absorption of forces.

Figure 19:
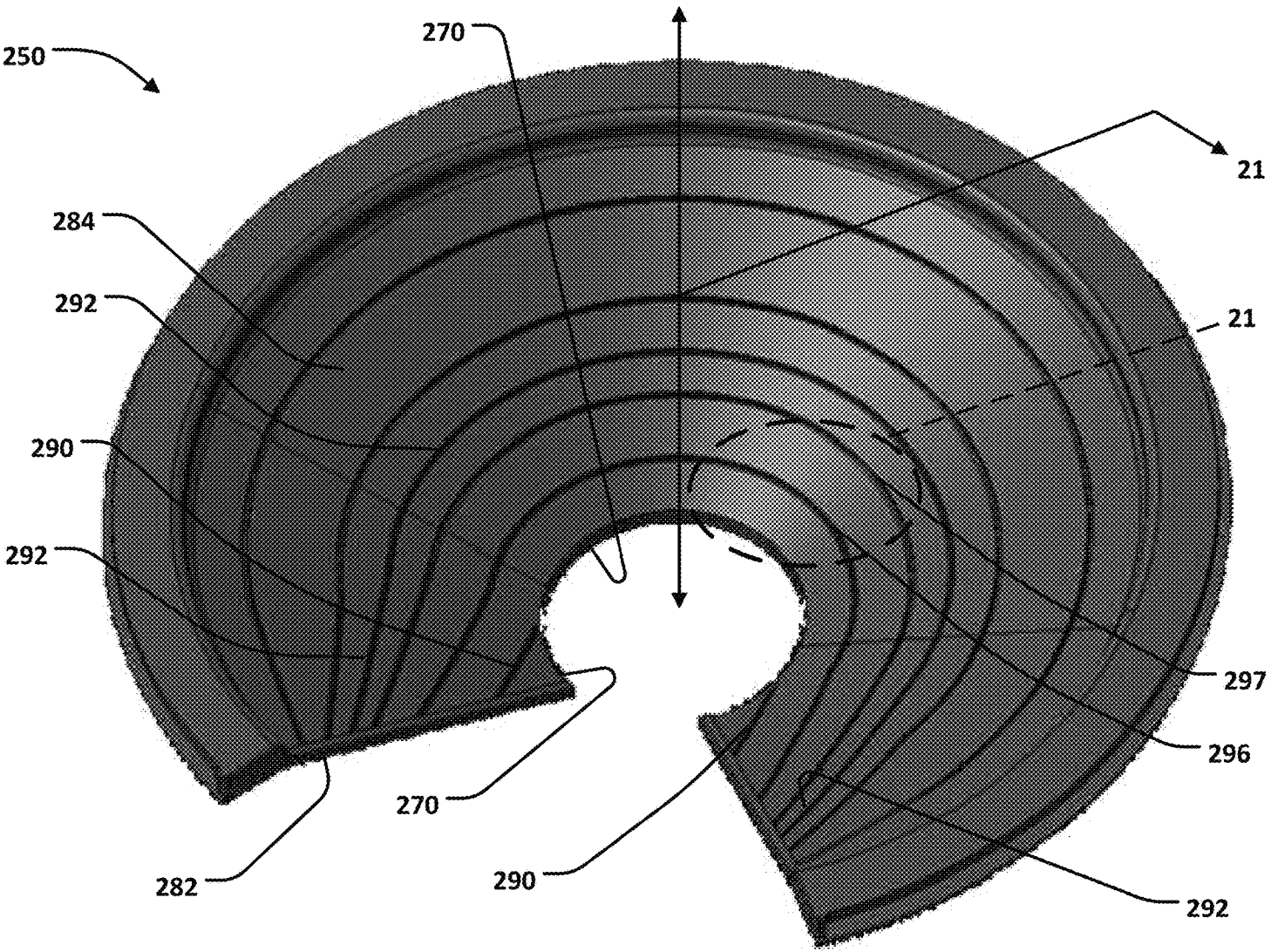
FIG. 19 is a perspective view of an alternative sealing portion that can be utilized in one or more embodiments of the present disclosure.
Figure 20:
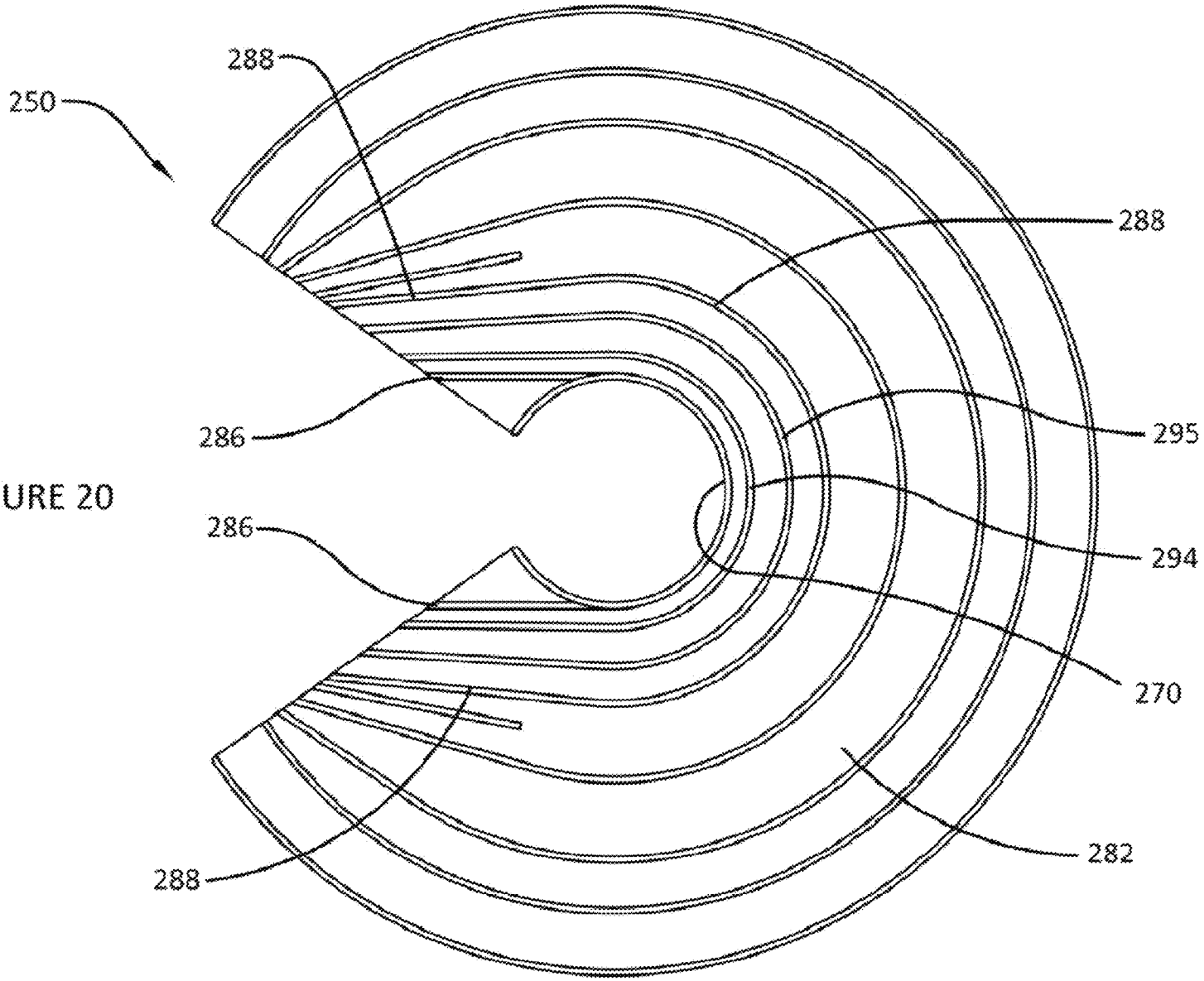
FIG. 20 is a top view of the alternative sealing portion shown in FIG. 19.
Figure 21:
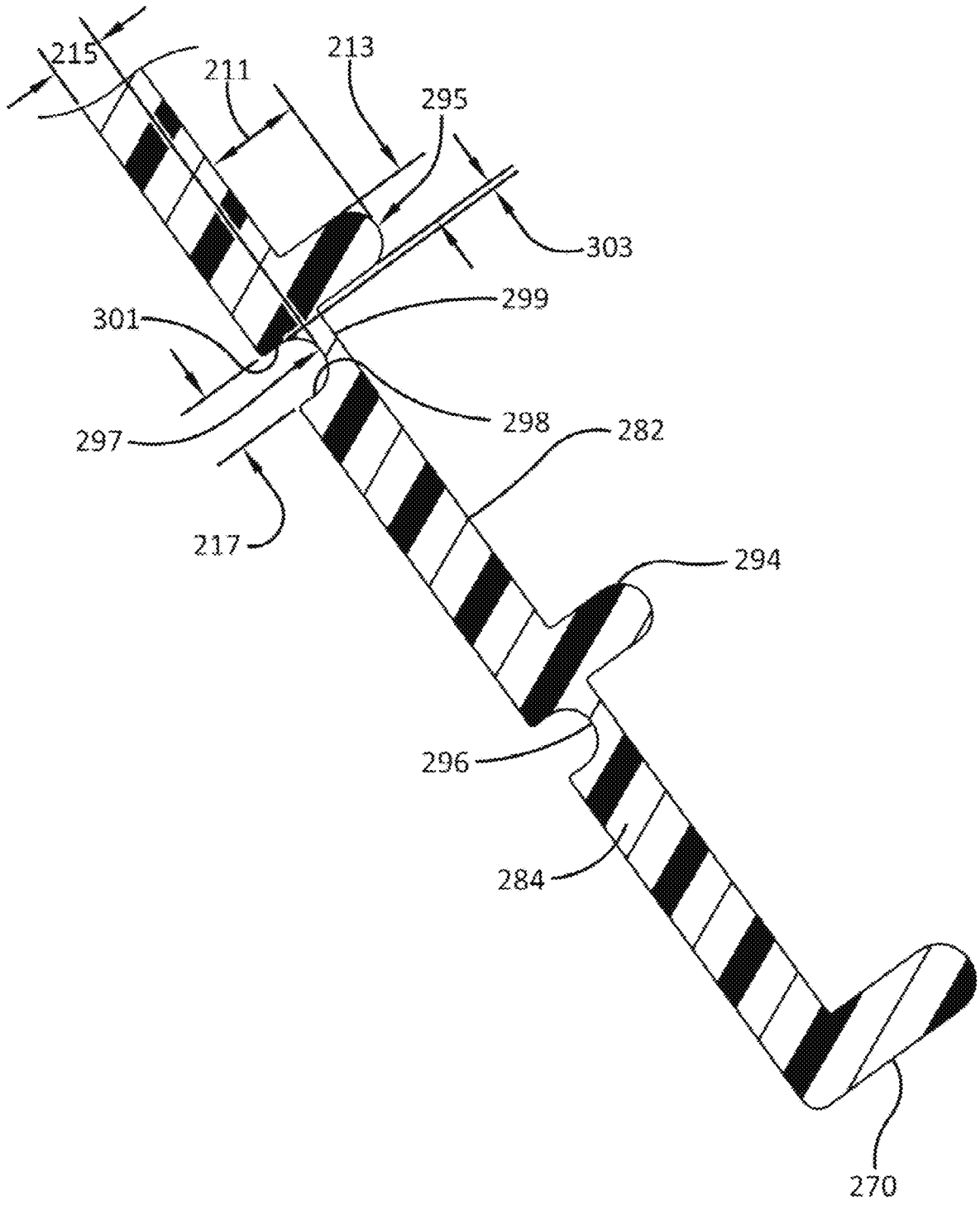
FIG. 21 is a cross-section through part of the alternative sealing portion shown in FIGS. 19 and 20.

FIGS. 19-21 are views of an alternative sealing portion 250 that can be utilized in one or more embodiments of the present disclosure. The exemplary sealing portion 250 can replace either or both of the sealing portions 50, 150. The exemplary sealing portion 250 includes a portion 270 that can define part of an aperture (such as aperture 68) to encircle a pipe. The exemplary sealing portion 250 defines a top surface 282 that would be facing outward/upwardly when the exemplary sealing portion 250, as part of an installed roof flashing, is in operation. The exemplary sealing portion 250 defines a bottom surface 284 that would be facing inward/downwardly when the exemplary sealing portion 250, as part of an installed roof flashing, is in operation. The exemplary sealing portion 250 includes beads, such as beads 286, 288, 294, 295, that project outwardly from the top surface 282. The exemplary sealing portion 250 also includes channels, such as channels 290, 292, 296, 297, that extend inwardly into the bottom surface 284.

FIG. 21 is a cross-section through part of the exemplary sealing portion 250. The cross-section is in the plane referenced by the number 21 in FIG. 19 and in the area of the circle referenced by number 21. In FIG. 21, a height of the exemplary bead 295 is referenced at 211. The height 211 can be 0.017 in. in an exemplary embodiment of the present disclosure and can be in the range of 0.01 in.–0.03 in. In FIG. 21, a width of the exemplary bead 295 is referenced at 213. The width 213 can be 0.059 in. in an exemplary embodiment of the present disclosure and can be in the range of 0.03 in.–0.08 in. In FIG. 21, a depth of the exemplary channel 297 is referenced at 215. The depth 215 can be 0.03 in. in an exemplary embodiment of the present disclosure and can be in the range of 0.01 in.–0.04 in. In FIG. 21, a width of the exemplary channel 297 is referenced at 217. The width 217 can be 0.033 in. in an exemplary embodiment of the present disclosure and can be in the range of 0.01 in.–0.04 in.

The exemplary channels and beads are formed such that a pair including a channel and a bead that are radially closest to one another (radial referencing the central axis of the aperture encircling the pipe in operation and in direction perpendicular to this axis) do not precisely overlap along a direction that is radially outward from a central axis of the aperture 42 or 142. For example, of a particular pair, such as a pair defined by bead 295 and channel 297, the bead 295 is radially outward of the channel 297. A radially-innermost side 298 of the exemplary channel 297 is closer to the central axis than a radially-innermost side 299 of the exemplary bead 295. A radially-outermost side 301 of the channel 297 is also closer to the central axis than the radially-innermost side 299 of the bead 295. A radial distance between the side 301 and the side 299 is referenced at 303 in FIG. 21. In the exemplary embodiment, the distance 303 is 0.02 in. The distance 303 is positive in the exemplary embodiment, but can be zero (the sides 301 and 299 are in the same plane) or negative (the side 299 is radially inward of side 301).

Parts of the sealing portion 250 can be removed to accommodate different sizes of pipe. The channels can define tear patterns in the exemplary sealing portion 250. An installer can initiate a tear in a channel. In the exemplary embodiment, the distance is positive and allows the bead 295 to inhibit undesired tearing of the exemplary sealing portion 250.

Figure 22:
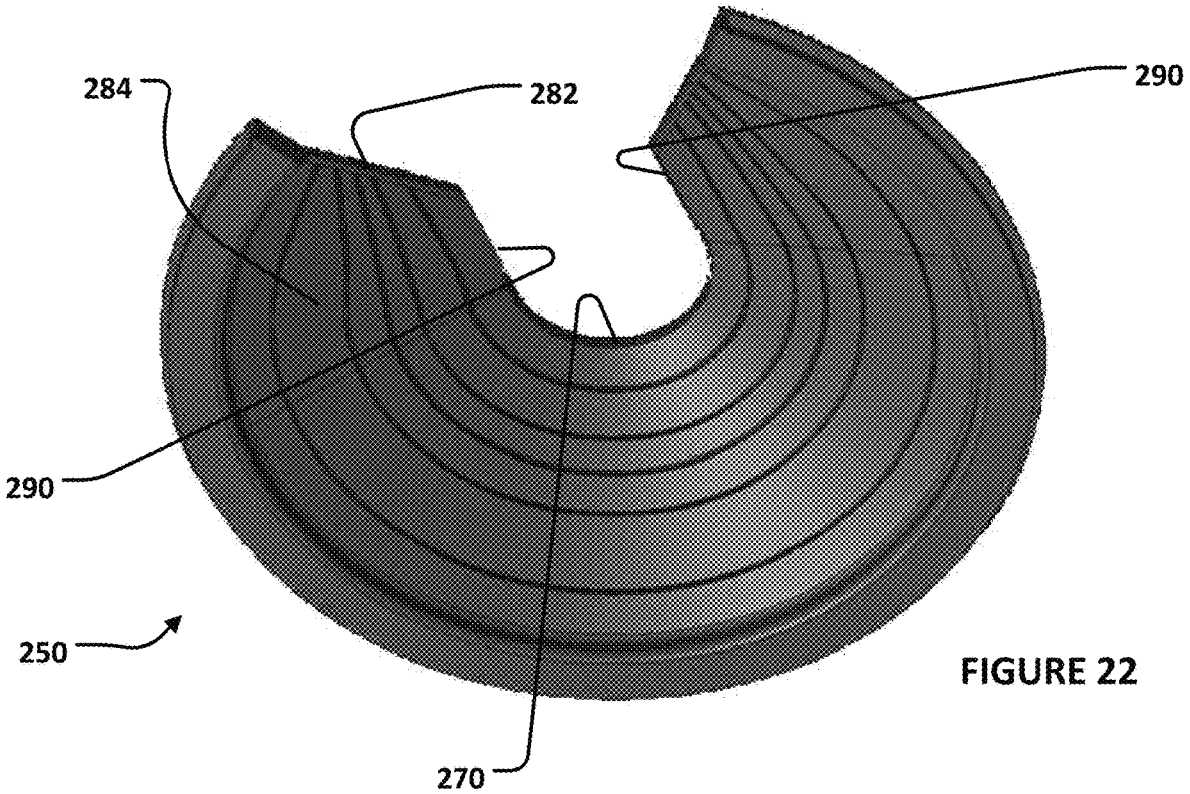
FIG. 22 is a perspective view of the alternative sealing portion shown in FIGS. 19-21 after being altered for a first operating environment.
Figure 23:
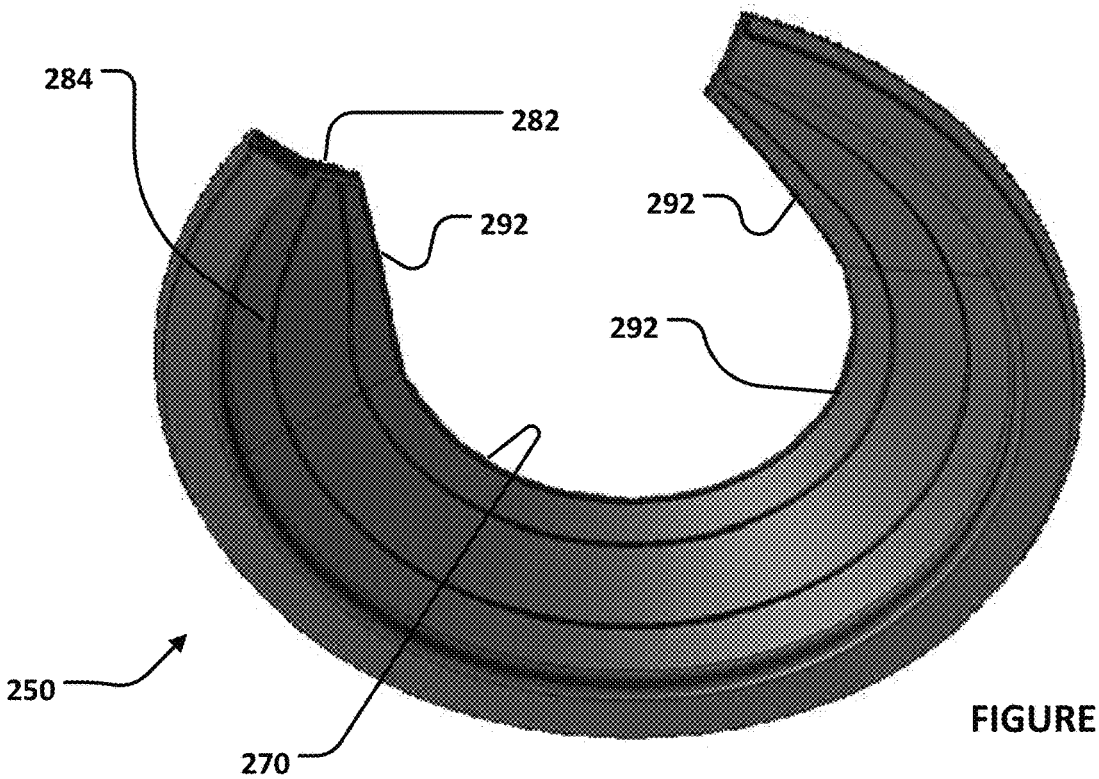
FIG. 23 is a perspective view of the alternative sealing portion shown in FIGS. 19-21 after being altered for a second operating environment.

FIG. 22 is a perspective view of the exemplary sealing portion 250 after being altered for a first operating environment. The part of the exemplary sealing portion 250 radially inward of the bead 286 has been removed by tearing the exemplary sealing portion 250 along the channel 290. FIG. 23 is a perspective view of the exemplary sealing portion 250 after being altered for a second operating environment. The part of the exemplary sealing portion 250 radially inward of the bead 288 has been removed by tearing the exemplary sealing portion 250 along the channel 292.

While the present disclosure has been described with reference to an exemplary embodiment, it will be understood by those skilled in the art that various changes may be made and equivalents may be substituted for elements thereof without departing from the scope of the present disclosure. In addition, many modifications may be made to adapt a particular situation or material to the teachings of the present disclosure without departing from the essential scope thereof. Therefore, it is intended that the present disclosure not be limited to the particular embodiment disclosed as the best mode contemplated for carrying out this present disclosure, but that the present disclosure will include all embodiments falling within the scope of the appended claims. The right to claim elements and/or subcombinations that are disclosed herein is hereby unconditionally reserved. The use of the word "can" in this document is not an assertion that the subject preceding the word is unimportant or unnecessary or "not critical" relative to anything else in this document. The word "can" is used herein in a positive and affirming sense and no other motive should be presumed. More than one "invention" may be disclosed in the present disclosure; an "invention" is defined by the content of a patent claim and not by the content of a detailed description of an embodiment of an invention.

What is claimed is:

1. A roof flashing comprising:

a bottom half having a first plate extending in a first plane and a first neck portion projecting away from said first plate and said first plane, said first neck portion being arcuate and centered on a first axis that intersects said first plane at an acute angle, said first neck portion defining a first portion of an aperture configured to encircle and seal against a post projecting away from a roof;

a top half having a second plate and a second neck portion projecting away from said second plate, said second neck portion being arcuate and centered on a second axis that intersects said second plate at an acute angle, said second neck portion defining a second portion of said aperture;

at least part of said first neck portion is slidably receivable in said second neck portion, said first neck portion and said second neck portion collectively defining a neck of said roof flashing when said bottom half and said top half are engaged with one another;

wherein said first plate extends a length between an upper edge and a lower edge thereof, said upper edge positioned closer to said first portion of said aperture than said lower edge, further wherein at least part of a perimeter of said first neck portion about said first axis is received in and overlapped by said second neck portion, said at least part of said perimeter defined beyond said upper edge and not along said length;

wherein said second plate extends a length between an upper edge and a lower edge thereof, said lower edge of said second plate positioned closer to said second portion of said aperture than said upper edge of said second plate, further wherein said second neck portion does not extend a beyond said lower edge of said second plate and extends along said length of said second plate;

wherein at least one of said first neck portion and said second neck portion further comprises a pipe portion formed from a first material and a sealing portion formed from a second material, wherein said sealing portion defines one of said first portion of said aperture and said second portion of said aperture and wherein said first material is more rigid than said second material;

wherein said sealing portion defines a top surface facing upwardly and a bottom surface facing downwardly and a plurality of beads projecting outwardly from said top surface and a plurality of channels extending inwardly into said bottom surface;

wherein said plurality of channels and said plurality of beads are formed such that a pair including a first channel of said plurality of channels and a first bead of said plurality of beads that are radially closest to one another do not overlap along a direction radially outward from a central axis of said one of said first portion of said aperture and said second portion of said aperture; and wherein a radially-outermost side of said first channel is closer to said central axis of said one of said first portion of said aperture and said second portion of said aperture than a radially-innermost side of said first bead along the direction radially outward from said central axis.

2. The roof flashing of claim 1 wherein said first bead is radially outward of said first channel along the direction radially outward from said central axis of said one of said first portion of said aperture and said second portion of said aperture.

3. The roof flashing of claim 1 wherein a radially-innermost side of said first channel is closer to said central axis of said one of said first portion of said aperture and said second portion of said aperture than said radially-innermost side of said first bead along the direction radially outward from said central axis.

4. The roof flashing of claim 1 wherein a distance along the direction radially outward from said central axis of said one of said first portion of said aperture and said second portion of said aperture, between said radially-outermost side of said first channel along the direction and said radially-innermost side of said first bead along the direction, is positive.

5. The roof flashing of claim 1 wherein a distance along the direction radially outward from said central axis of said one of said first portion of said aperture and said second portion of said aperture, between said radially-outermost side of said first channel along the direction and said radially-innermost side of said first bead along the direction, is zero.

6. The roof flashing of claim 1 wherein a distance along the direction radially outward from said central axis of said one of said first portion of said aperture and said second portion of said aperture, between said radially-outermost side of said first channel along the direction and said radially-innermost side of said first bead along the direction, is negative.

7. The roof flashing of claim 1 wherein both of said first neck portion and said second neck portion further comprise respective pipe portions formed from a first material and respective sealing portions formed from a second material, wherein said sealing portions respectively define said first portion and said second portion of said aperture, wherein said first material is more rigid than said second material, wherein said sealing portions define respective top surfaces facing upwardly and respective bottom surfaces facing downwardly and also define respective pluralities of beads projecting outwardly from said respective top surfaces and also define respective pluralities of channels extending inwardly into said respective bottom surfaces.

8. The roof flashing of claim 1 wherein a height of at least one of said plurality of beads formed in said sealing portion is in a range of 0.01 in.–0.03 in.

9. The roof flashing of claim 1 wherein a width of at least one of said plurality of beads formed in said sealing portion is in a range of 0.03 in.–0.08 in.

10. The roof flashing of claim 1 wherein a depth of at least one of said plurality of channels formed in said sealing portion is in a range of 0.01 in.–0.04 in.

11. The roof flashing of claim 1 wherein a width of at least one of said plurality of channels formed in said sealing portion is in a range of 0.01 in.–0.04 in.

* * * * *